US007240645B2

(12) United States Patent
Reisser

(10) Patent No.: US 7,240,645 B2
(45) Date of Patent: Jul. 10, 2007

(54) INTERNAL COMBUSTION ENGINE

(76) Inventor: Heinz-Gustav A. Reisser, 44494 S.R. 541, Coshocton, OH (US) 43812-0655

( * ) Notice: Subject to any disclaimer, the term of this patent is extended or adjusted under 35 U.S.C. 154(b) by 0 days.

(21) Appl. No.: 11/260,372

(22) Filed: Oct. 28, 2005

(65) Prior Publication Data

US 2007/0095309 A1 May 3, 2007

(51) Int. Cl.
*F01B 3/00* (2006.01)
*F02B 75/20* (2006.01)

(52) U.S. Cl. ..... 123/45 R; 123/59.6

(58) Field of Classification Search ..... 123/53.6, 123/59.6, 45 R, 45 A
See application file for complete search history.

(56) References Cited

U.S. PATENT DOCUMENTS 1,290,496 A * 1/1919 Boyd ..... 123/45 R
1,613,136 A * 1/1927 Schieffelin ..... 123/57.1
5,517,952 A * 5/1996 Wielenga ..... 123/45 A
5,979,399 A * 11/1999 Piock et al. ..... 123/301

FOREIGN PATENT DOCUMENTS

EP 65068 A2 * 11/1982
WO WO 9920878 A1 * 4/1999

* cited by examiner

*Primary Examiner*—Noah P. Kamen
(74) *Attorney, Agent, or Firm*—Paul Vincent

(57) ABSTRACT

The invention concerns an internal-combustion engine, the engine comprising a first combustion chamber, a first piston displaceably guided in the first combustion chamber, the first piston facing the first combustion chamber with a first piston surface in a first direction, a second combustion chamber, a second piston displaceably guided in the second combustion chamber, the second piston facing the second combustion chamber with a second piston surface in a second direction, the first direction and the second direction being opposed to each other, the first piston and the second piston being coupled to each other so that they move simultaneously.

15 Claims, 5 Drawing Sheets

INTERNAL COMBUSTION ENGINE

BACKGROUND OF THE INVENTION

The invention concerns an internal-combustion engine with a first combustion chamber, a first piston displaceably guided in said first combustion chamber, this first piston facing said first combustion chamber with a first piston surface in a first direction, a second combustion chamber, a second piston displaceably guided in said combustion chamber, this second piston facing said second combustion chamber with a second piston surface in a second direction, said first direction and said second direction being opposed to each other.

Engines of this type are known as engines of the "boxer type". They can be used as stationary drives as well as for vehicles.

Despite substantial progress having been achieved in making internal-combustion engines more efficient, there is still a great need for further improvement of the efficiency of such engines, may it be two-cycle or four-cycle, otto- or diesel-engines.

It is the underlying purpose of the invention to provide a combustion engine having higher efficiency.

SUMMARY OF THE INVENTION

This object is achieved in accordance with the invention with a combustion engine of the above-mentioned type, wherein said first piston and said second piston are coupled to each other so that they move simultaneously.

In contrast to a combustion engine of the "boxer type", the pistons of the inventive combustion engine do not travel independently of each other. Thereby, the upstroke of the first piston corresponds to the downstroke of the second piston and vice versa. Applying the two cycle principle to the inventive engine, one obtains an engine, that will be very efficient, since every stroke of the two pistons coupled to each other will involve one power stroke. The power strokes are alternately allocated to one of the two combustion chambers.

It is understood, that the principle underlying the invention can also be applied to engines using the four-cycle principle. This will also lead to an engine with higher efficiency, since the two pistons do not have to be guided separately as known from common engines.

It is also understood, that the principle underlying the invention can be applied to engines having more than two combustion chambers.

In one embodiment, the directions, in which the piston surfaces face are directed away from each other. This means, that the pistons are disposed between the combustion chambers.

In another embodiment, the mentioned directions are directed towards each other. This means that the two combustion chambers are disposed between the two pistons.

In a particularly preferred embodiment, the two pistons travel along a common axis. This will further increase the efficiency of the engine, since the shear forces, that act perpendicular to the axis, along which the pistons travel, can be eliminated.

Each piston can drive separate crankshafts, which can be arranged such that the pistons are disposed between the crankshafts. This arrangement leads to a comparatively flat engine, wherein the energy of the power strokes can be transmitted to the crankshafts in an efficient manner.

A particularly preferred embodiment of the invention comprises pistons which are rotatably disposed within the combustion chambers. This further minimizes shear forces and friction between the pistons and the walls of the combustion chambers.

In a particularly preferred embodiment, the engine comprises drive means to rotate said pistons. This means, that the pistons are not only rotatably disposed within the combustion chambers, but that they are actively driven to rotate within the combustion chambers. Rotating the pistons will minimise friction between the pistons and the walls of the combustion chambers. The rotation can be continuous, so that the pistons rotate independently of their position along their axis of travel. However, the pistons may be driven in a way that they do not rotate along its entire stroke length.

It is understood, that the mentioned drive means can be provided by a separate drive. However, it is preferred, that the drive means comprise gear means that are coupled with at least one of the crankshafts. This eliminates the need for a separate drive and has the advantage, that the rotation speed of the pistons is coupled to the rotation speed of the crankshafts. By choosing an appropriate gear ratio, the rotation speed of the pistons can be adjusted.

In a preferred embodiment the gear means comprise a gear wheel that drives at least one of the pistons. In some embodiments it will be appreciated that the two pistons are driven to avoid torque loads. It is preferred, that said gear wheel interacts with at least one of the pistons which comprises a surface comprising teeth extending parallel to the axis along which the piston travels, wherein the teeth have a length that is at least as great as the stroke length of the piston. This gear arrangement allows for rotating the piston along its entire stroke length, which has the above-mentioned advantages for minimizing friction.

To further increase the efficiency of the inventive engine, it is proposed, that the piston surfaces facing the combustion chambers have inclined sections to create a vortex flow within the combustion chambers when rotating the pistons. This vortex flow has several advantages. On the one hand the gas contained in the combustion chambers can be put into a whirling movement so that the gases in the combustion chambers are mixed homogenously, thus achieving uniform combustion and cleaner exhaust gas. The vortex flow is also very beneficial for exchanging the gas mixture in the combustion chambers. The vortex flow can be used to suck fresh air into the combustion chamber as well as to push exhaust gas out of the combustion chamber. This is particularly helpful for engines using the two-cycle principle.

In one embodiment of the invention the combustion chambers can be constituted by a single cylinder. This means that the walls of the two combustion chambers are in flush configuration with each other, so that the two combustion chambers can be manufactured very easily without misalignment of the two combustion chambers. In this case it is proposed to integrate the two pistons into one unit, so that they are built integrally with each other. This unit does not necessarily need to be one-pieced; it can comprise more pieces that are assembled with each other.

In another embodiment the combustion chambers are constituted by separate cylinders. For coupling the two pistons it is proposed to connect these pistons by means of a connecting shaft. This connecting shaft allows for the arrangement of the above-mentioned surface comprising teeth to be driven by a gear wheel to rotate the two pistons.

The pistons can each comprise a piston extension, wherein the piston extensions each extend through one of the combustion chambers, wherein the piston extensions are each coupled with a connection rod and wherein each connection rod is coupled with one of the crankshafts. This arrangement allows for a reliable transmission of forces induced by the power strokes onto the crankshafts. When in this configuration the piston extensions and the connection rods are coupled to each other by means of a ball and socket bearing, the pistons can be rotated as described above.

The surface comprising teeth which are driven by a gear wheel can also be disposed on at least one of the piston extensions.

Further advantages, features and details of the invention can be extracted from the dependent claims and the following description which describes in detail a particularly preferred embodiment with reference to the drawing. The features shown in the drawing and mentioned in the claims and in the description may be essential to the invention either individually or in arbitrary combination.

DESCRIPTION OF THE PREFERRED EMBODIMENT

Figure 1:
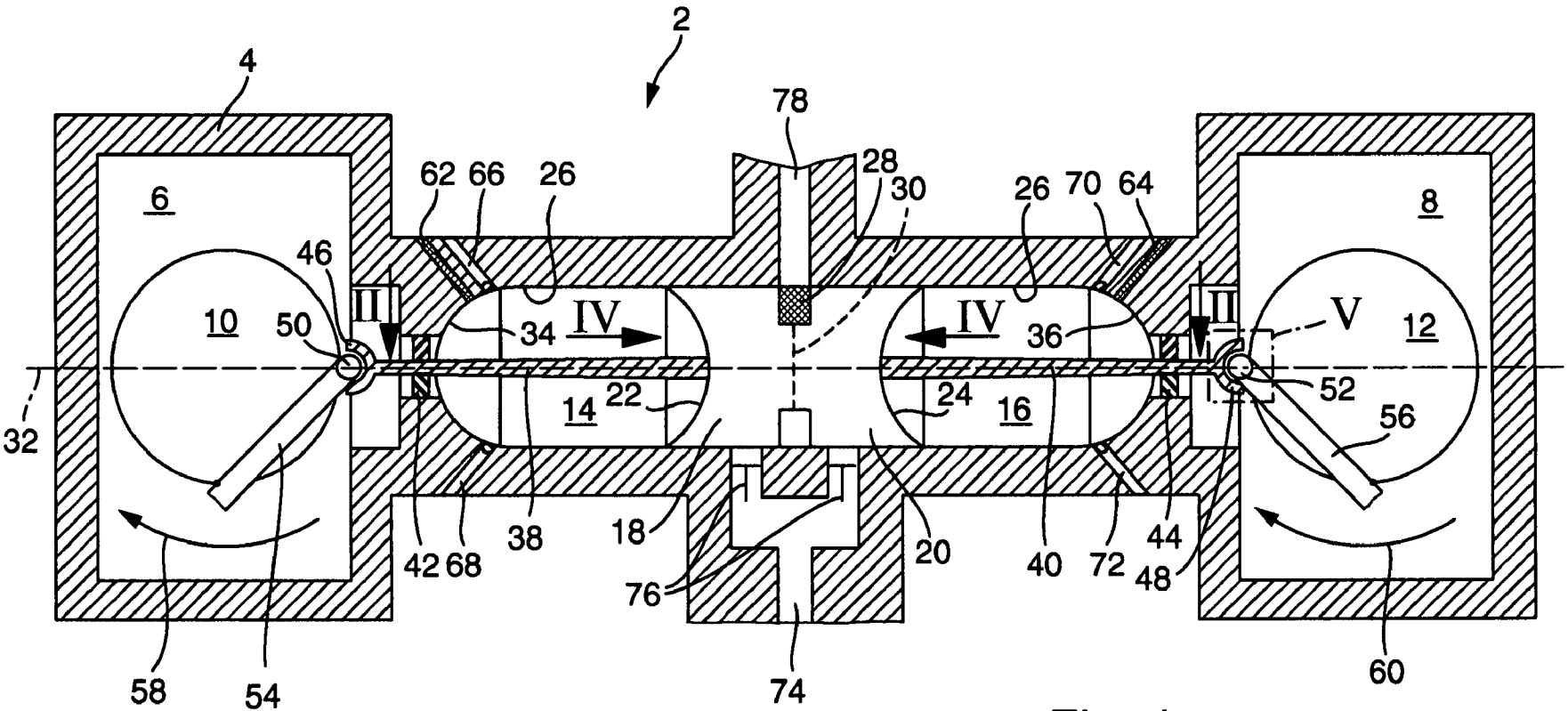
FIG. 1 shows a section through a preferred embodiment of the inventive combustion engine.

FIG. 1 shows a side section of an engine which is designated with reference numeral 2. The engine 2 comprises a housing 4 with two opposite crankhouses 6 and 8, in which crankshafts 10 and 12 are located, respectively.

Between the crankshafts 10 and 12 two combustion chambers 14 and 16 are arranged. A first piston 18 is allocated to the first combustion chamber 14. A second piston 20 is allocated to the second combustion chamber 16. The pistons 16 and 20 are disposed between the two combustion chambers 14 and 16. The latter are disposed between the two crankshafts 10 and 12.

The piston 18 comprises a piston surface 22 which faces the first combustion chamber 14. The second piston 20 has a second piston surface 24 which faces the second combustion chamber 16. The two piston surfaces 22 and 24 face away from each other.

The pistons 18 and 20 are integrated to one unit which can travel along a single cylinder 26. The pistons 18 and 20 comprise a centrally arranged piston ring 28, which seals the pistons 18 and 20 with respect to the walls of the cylinder 26. The piston ring 28 may be of elastic or non-elastic material. If the piston ring 28 is made of non-elastic material (e.g. ceramics), the pistons 18 and 20 may be constituted by two separate parts, as it is indicated by a dashed section-line 30.

The pistons 18 and 20 travel along a common axis 32. In FIG. 1, the pistons 18 and 20 are in the middle position between the two top dead centre positions. In top dead centre position, the piston 18 and the wall of the housing 4 opposing the piston surface 22 have a spherical shape. This is because of the piston surface 22 having a spherical shape and the opposing surface of the housing 4 also having a spherical shape 34. The combustion chamber 16 is symmetrical to the combustion chamber 14, thus also having a spherical wall 36 opposing the spherical piston surface 24.

The piston 18 comprises a piston extension 38, which is integrally built with piston 18 or connected to piston 18. The piston extension 38 extends through the combustion chamber 14. The piston 20 comprises a piston extension 40, extending through combustion chamber 16. Both piston extensions 38 and 40 extend through walls of the crankcases 6 and 8, respectively, passing a bearing 42 and 44, respectively. The piston extensions 38 and 40 carry at their free ends, which are facing away from the pistons 18 and 20, sockets 46 and 48, respectively. These sockets 46 and 48 interact with corresponding balls 50 and 52 which are provided on connection rods 54 and 56. Each connection rod 54 and 56, respectively, is coupled to one of the crankshafts 10 and 12, respectively. When the pistons 16 and 18 move in a simultaneous manner, each upstroke of one piston corresponds to a downstroke of the other piston. The arrangement of the connection rods 54 and 56 and the crankshafts 10 and 12 is such that the crankshafts 10 and 12 turn in the same rotation directions 58 and 60.

The combustion chambers 14 and 16 are supplied with fuel by fuel injection units 62 and 64 (multi port in one chamber). These fuel injection units 62 are disposed within the spherical walls 34 and 36, respectively. In these regions two pairs of spark plugs 66, 68 and 70, 72 are provided.

The engine 2, that is their combustion chambers 14 and 16, is provided with fresh air by an intake 74, which separates into two branches. In each branch a one-way valve 76 is arranged, so that air from the intake 74 into the combustion chambers 14 and 16 can only flow in this direction. On the opposite side of the intake 74 an exhaust 78 is provided.

The transport of air into the combustion chambers 14 and 16 is supported by an air cooling and pressure system. Fresh air is forced through an inter-cooler into a pressure tank via a compressor that is driven by the engine 2. The intake system also comprises a throttle body to regulate the air pressure and volume, an air pressure sending unit and a mass-air-flow sensor.

Figure 4:
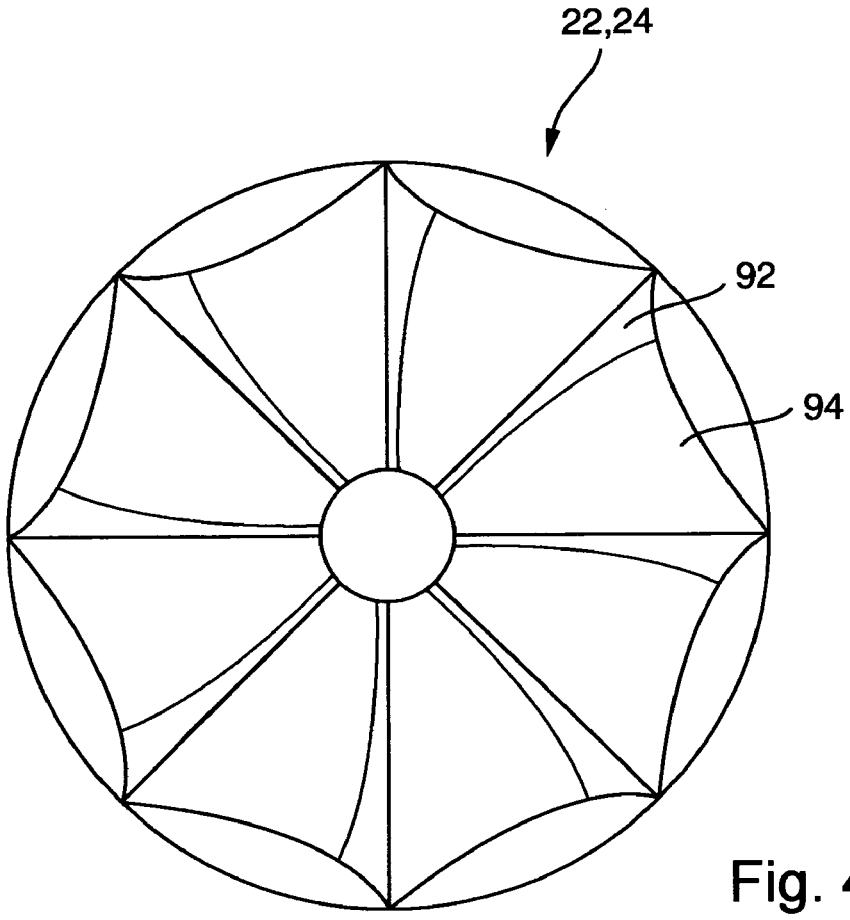
FIG. 4 shows a top view of a piston surface in accordance with FIG. 1.

The intake of air is also facilitated by the particular shape of the piston surfaces 22 and 24 which will be further described in accordance with FIG. 4.

The pistons 16 and 18 are rotatably disposed within the cylinder 26. The piston extensions 38 and 40 and thereby the pistons 18 and 20 are driven by drive means acting on the piston extensions 38 and 40. These drive means act on the piston extensions in regions 11 indicated in FIG. 1. The piston extensions 38 and 40 each comprise a surface 80 having teeth. This ridged surface 80 is meshing with a gear wheel 82, which at one end comprises an angle portion 34. This angle portion 34 is meshing with a gear wheel 86.

Figure 3:
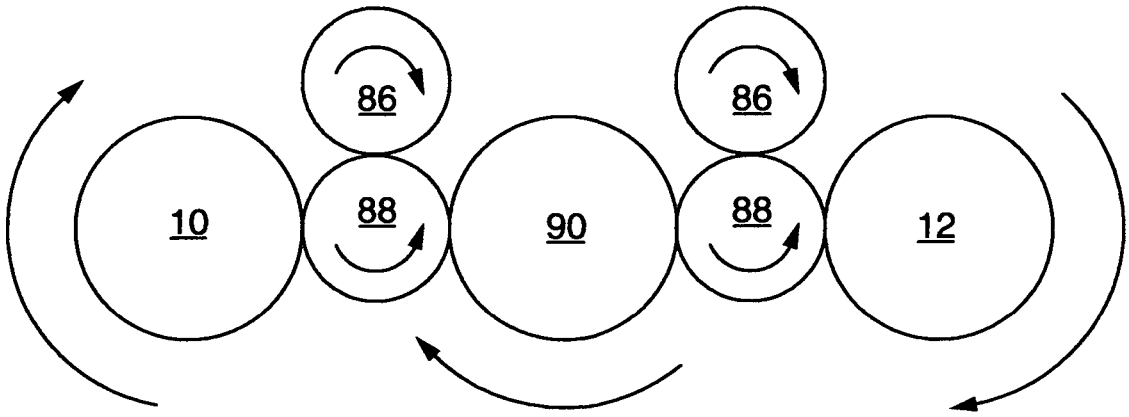
FIG. 3 shows a schematic view of gear elements of the engine.

FIG. 3 shows, how the gear wheel 86 is driven. The two crankshafts 10 and 12 drive intermediate transfer gears 88, which are coupled to the gears 86. Each gear 86 drives a gear wheel 82, which in turn drives one of the piston extensions 38 and 40. Since the teeth provided on the surface 80 are at least as long as the stroke length of each piston 16 and 18, the pistons 16 and 18 can be rotationally driven along its entire stroke length.

FIG. 3 also shows, that the transfer gears 88 are coupled with a common fly wheel 90. This fly wheel helps to eliminate unwanted vibrations of the engine 2.

FIG. 4 shows that the piston surfaces 22 and 24, which on a macro scale have a spherical shape, are provided with inclined sections 92 and 94 on a smaller scale. These inclined sections 92 and 94 form a propeller shape, which helps to create a vortex flow within the combustion chambers 14 and 16, when the pistons 16 and 18 are rotationally driven, such as described above. The particular shape of the piston surfaces 22 and 24 also helps to suck fresh air through intake 74 and to push exhaust gas out through exhaust 78.

Figure 5:
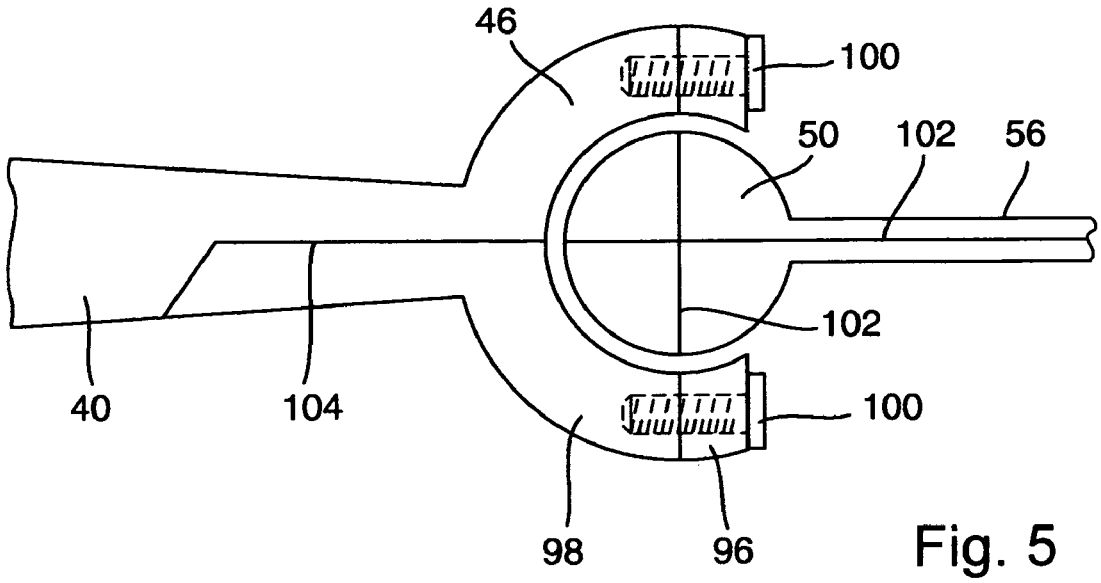
FIG. 5 shows an enlarged view of the region V in accordance with FIG. 1.

FIG. 5 shows an enlarged view of the region V, indicated in FIG. 1. The piston extension 40 carries at its free end the said socket 46. This socket 46 is constituted by an upper part 96 and a bottom part 98. The two parts 96 and 98 are secured to each other by means of screws 100. The upper part 96 can be detached from the bottom part 98 to place the said ball 50 of the connection rod 56 within the socket part belonging to the bottom part 98. Fixing the upper part 96 to the bottom part 98 will attach the ball 50 securely within the socket 46.

The connection rod 56 has central lubrication or oil channels 102, through which lubrication fluid or oil can be driven into the ball and socket region, thereby cooling the connection between the piston extension 40 and the connection rod 56. This cooling will enable thermal stability of the engine 2, when the piston extension 40 is driven at high rotational speeds. To further improve cooling, the piston extension 40 may comprise lubrication or oil channels 104, too.

Figure 6:
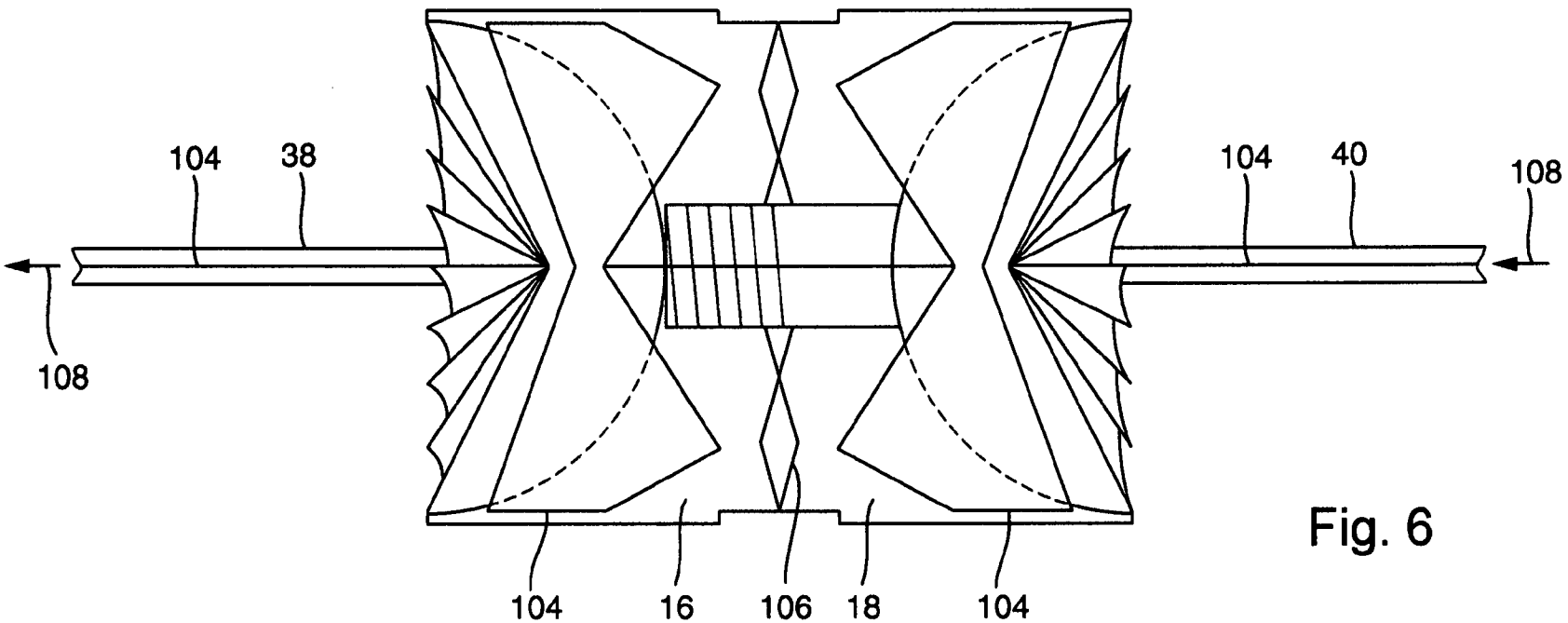
FIG. 6 shows an alternative embodiment of pistons being built integrally with each other.

FIG. 6 shows an alternative embodiment of pistons 16 and 18, which are connected to each other by means not shown in further detail. Between 16 and 18 a spring 106 is arranged, which allows for thermal expansion, when the pistons 16 and 18 and the piston extensions 38 and 40 expand, because of the engine 2 warming up to operating temperature.

In FIG. 6 pistons 16 and 18 are shown in an "x-ray" illustration. Within the piston extensions 38 and 40 and the pistons 16 and 18 lubrication or oil channels 104 are provided, to cool the pistons 16 and 18. Arrows 108 indicate how lubrication fluid or oil can flow through one piston extension 40, through lubrication or oil channels 104 within piston 18 to lubrication or oil channels 104 within piston 16 to a lubrication or oil channel 104 within piston extension 38.

Figure 7:
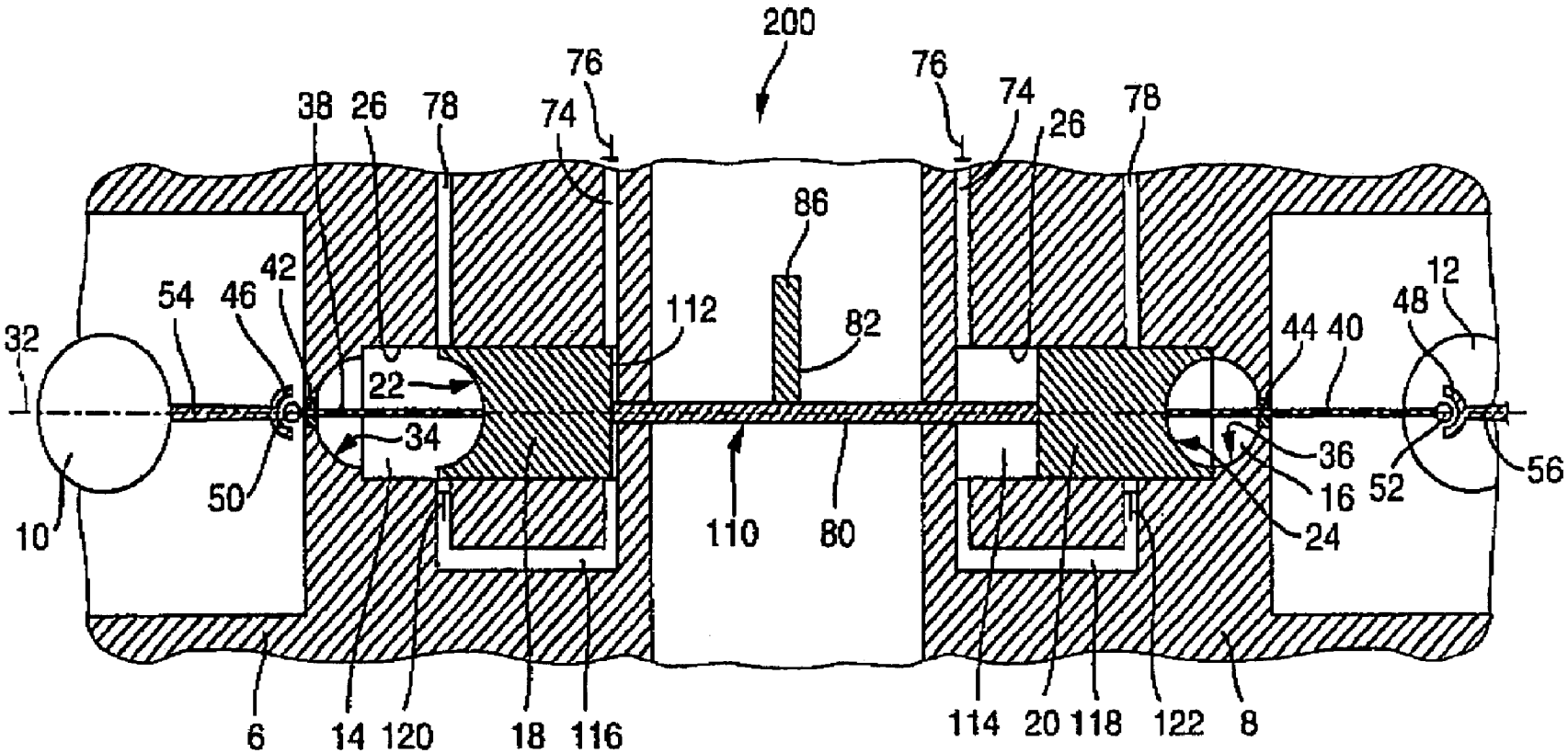
FIG. 7 shows a section through a second embodiment of the inventive combustion engine.

FIG. 7 shows a second embodiment of the inventive engine. The engine shown in FIG. 7 is designated with reference numeral 200. Parts of engine 200 that have the same function as parts of engine 2 according to FIGS. 1 to 6, are designated with the same reference numerals. For all parts, which are not mentioned in the following specification, reference is made to the above specification corresponding to FIGS. 1 to 6.

Figure 2:
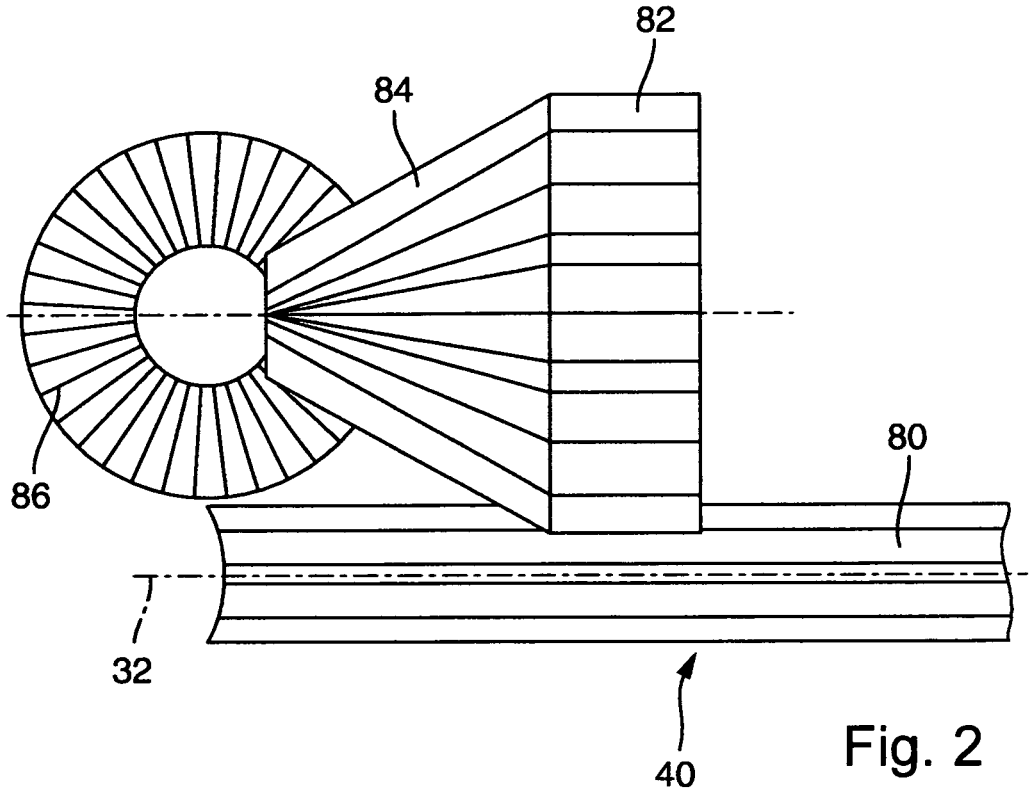
FIG. 2 shows an enlarged view of the region 11 in accordance with FIG. 1.

In the embodiment shown in FIG. 7 the two pistons 18 and 20 are not integrally built with each other, but separate and connected to each other by means of a connecting shaft 110. This connecting shaft 110 has a surface with teeth parallel to the axis of travel 32 of the pistons 18 and 20. This connecting shaft 110 is driven by a gear wheel 82 which in turn is driven by another gear wheel 86. Gear wheel 86 is driven by at least one of the crankshafts 10 and 12. This can be achieved by a gear drive, for example by a gear drive as shown in FIG. 2.

The pistons 18 and 20 are facing combustion chambers 14 and 16, respectively. These combustion chambers have the same shape as already described with respect to the first embodiment in accordance with FIGS. 1 to 6. However, in the embodiment shown in FIG. 7, the pistons 18 and 20 delimit with their bottom surfaces, facing towards each other and arranged around the connecting shaft 110, air chambers 112 and 114, respectively. The air chambers are also delimited by walls of the crankcases 6 and 8 as well as walls of cylinders 26, in which the pistons 18 and 20 are displaceably guided.

The air chambers 112 and 114 are provided with fresh air by intakes 74, in which one way valves 76 are arranged. When the piston 18 travels from its shown bottom dead centre position to its top dead centre position, the air chamber 112 increases in volume and sucks air through the intake 74 into the air chamber 112. When piston 18 travels from its top dead centre position back to the bottom dead centre position as shown in FIG. 7, the air contained in air chamber 112 is pushed through an air channel 116 into the combustion chamber 14. The air being forced into the combustion 14 passes another one-way valve 120. The air providing system of combustion chamber 16 functions in the same way. Air sucked into the air chamber 114 can flow through an air channel 118, pass a one-way valve 122 and is forced into the combustion chamber 16.

It is understood, that the piston surfaces 22 and 24 can have the same shape as shown in FIG. 4. This will support the intake of fresh air and will also facilitate pushing the exhaust gas through exhausts 78.

The embodiment shown in FIG. 7 has the advantage that its overall width as defined between the two crankshafts 10 and 12 can be comparatively small.

I claim:

1. An internal-combustion engine, the engine comprising;

a first combustion chamber;

a first piston displaceably guided in said first combustion chamber, said first piston facing said first combustion chamber with a first piston surface in a first direction;

a second combustion chamber;

a second piston displaceably guided in said second combustion chamber, said second piston facing said second combustion chamber with a second piston surface in a second direction, wherein said first direction and said second direction are opposed to each other, said first piston and said second piston being coupled to each other so that they move simultaneously, wherein said pistons are rotatably disposed within said combustion chambers, and further comprising drive means to rotate said pistons, said drive means having gear means coupled with at least one crank shaft, said gear means comprising a gear wheel driving at least one of said pistons, wherein at least one of said pistons cooperates with a member having teeth, said member extending parallel to axes along which said at least one piston travels, said teeth having a length at least as great as a stroke length of said piston.

2. The engine of claim 1, wherein said first and second directions are directed away from each other.

3. The engine of claim 2, wherein said pistons each comprise a piston extension, said piston extensions each extending through one of said combustion chambers and each being coupled with a connection rod, each connection rod being coupled with one of said crankshafts.

4. The engine of claim 3, wherein said piston extensions and said connection rods are coupled to each other by means of a ball and socket bearing.

5. The combustion engine of claim 3, wherein said member is disposed on at least one of said piston extensions.

6. The engine of claim 1, wherein said first and second directions are directed towards each other.

7. The engine of claim 1, wherein said first and second pistons travel along a common axis.

8. The engine of claim 1, wherein said first piston drives a first crankshaft and said second piston drives a second crankshaft.

9. The engine of claim 8, wherein said first piston and said second piston are disposed between said crankshafts.

10. The engine of claim 1, wherein said piston surfaces facing said combustion chambers have inclined sections to create a vortex flow within said combustion chambers.

11. The engine of claim 1, wherein said combustion chambers constitute a single cylinder.

12. The engine of claim 11, wherein said pistons are built integrally with each other.

13. The engine of claim 1, wherein said combustion chambers constitute separate cylinders.

14. The engine of claim 13, wherein said pistons are coupled to each other by means of a connecting shaft.

15. The engine of claim 1, wherein said member comprising teeth is disposed on a connecting shaft.

* * * * *